US006644039B2

(12) United States Patent
Hughes et al.

(10) Patent No.: US 6,644,039 B2
(45) Date of Patent: Nov. 11, 2003

(54) DELIVERY SYSTEM FOR LIQUEFIED GAS WITH MAINTAINED DELIVERY TANK PRESSURE

(75) Inventors: Michael F. Hughes, Oklahoma City, OK (US); Paul J. Lutes, Edmond, OK (US); Don D. Crowder, Oklahoma City, OK (US); Alan P. Tiefenbrun, Oklahoma City, OK (US)

(73) Assignee: Corken, Inc., Oklahoma City, OK (US)

( * ) Notice: Subject to any disclaimer, the term of this patent is extended or adjusted under 35 U.S.C. 154(b) by 0 days.

(21) Appl. No.: 10/032,183

(22) Filed: Dec. 21, 2001

(65) Prior Publication Data

US 2002/0083719 A1 Jul. 4, 2002

Related U.S. Application Data

(60) Provisional application No. 60/257,940, filed on Dec. 21, 2000.

(51) Int. Cl.[7] ..... F17C 13/02; F17C 7/02; B65D 1/28; B65D 3/22

(52) U.S. Cl. ..... 62/49.1; 62/50.1; 141/82

(58) Field of Search ..... 62/45.1, 50.1, 62/49.1, 53.2; 141/82

(56) References Cited

U.S. PATENT DOCUMENTS 2,453,766 A * 11/1948 Thayer ..... 62/50.1
2,502,184 A * 3/1950 Thayer ..... 62/50.1
2,798,365 A * 7/1957 Hesson ..... 62/50.1
3,110,156 A * 11/1963 Niemann ..... 62/45.1
RE29,463 E * 11/1977 Bognaes et al. ..... 62/55.1
5,243,821 A * 9/1993 Schuck et al. ..... 417/53
5,354,088 A * 10/1994 Vetter et al. ..... 141/82
5,360,139 A * 11/1994 Goode ..... 141/18
5,505,232 A * 4/1996 Barclay ..... 123/525
5,762,119 A * 6/1998 Platz et al. ..... 141/18
5,954,101 A * 9/1999 Drube et al. ..... 141/18
2001/0050167 A1 * 12/2001 Buysse et al. ..... 165/279

* cited by examiner

*Primary Examiner*—William C. Doerrler
(74) *Attorney, Agent, or Firm*—Fellers, Snider, et al.

(57) ABSTRACT

A delivery system for transferring a delivery fluid from a delivery tank to a customer tank while maintaining a predetermined vessel pressure in the delivery tank, including a pump assembly pumping fluid from the delivery tank and a piping system passing the pumped fluid to the customer tank. A diverter diverts a slip stream portion of the pumped delivery fluid and a heat exchanger assembly selectively heats or cools the slip stream portion for return to the delivery tank. A sensor monitors a selected condition in the delivery tank and a controller responds to the sensor to control the amount and thermal condition of the slip stream returned to the delivery tank.

10 Claims, 4 Drawing Sheets

DELIVERY SYSTEM FOR LIQUEFIED GAS WITH MAINTAINED DELIVERY TANK PRESSURE

RELATED APPLICATIONS

This application claims priority to U.S. Provisional Application No. 60/257,940 filed Dec. 21, 2000.

FIELD OF THE INVENTION

This invention relates generally to the field of fluid delivery systems and more particularly, but not by way of limitation, to delivery of liquefied gases from a point of sale delivery vessel while maintaining a predetermined vessel pressure so as to improve liquid transfer.

BACKGROUND

Liquefied gases, such as liquefied petroleum gas (LPG) or anhydrous ammonia, are often stored in vessels for on demand use by a customer. These liquids are referred to as liquefied gases because at standard temperature and pressure, these substances are gaseous. Thus, to transport large quantities of the liquefied gases, sometimes referred to as delivery fluids, the substances are pressurized or refrigerated to maintain the substances liquefied.

From time to time, a customer vessel or tank is refilled using a portable liquid delivery system. The liquid delivery system includes a liquid delivery vehicle having a pressurized delivery tank and associated equipment to transfer the delivery fluid. A typical fluid transfer from such a vehicle involves connecting a hose from the delivery tank to the customer tank and pumping delivery fluid from the delivery tank to the customer tank while metering the flow to determine the total amount of delivery fluid transferred to the customer tank.

Because the delivery truck comprises the point of sale, it is generally undesirable to connect a second hose from the vapor space of the customer tank to the vapor space of the delivery tank to maintain vessel pressure in the delivery tank. This arrangement allows some amount of vaporized delivery fluid to transfer back from the customer tank to the delivery tank. As a result, as liquid delivery fluid is drawn from the delivery tank, the pressure drops in the vapor space of the delivery tank and the liquid will boil to fill the vapor space to maintain an equilibrium state. This boiling, if sufficiently violent, can cause vapor to be drawn into the pump inlet, reducing delivery fluid transfer rate and causing cavitation, noise, vibration and ultimate damage to the pump, meter and hoses. This phenomenon becomes more likely as the delivery tank approaches an empty liquid level.

A solution to this problem has been proposed by Midwest Meter Company, Hampton, Iowa, USA, involving a shell-and-tube heat exchanger that receives a small amount of fluid from the delivery tank into a first conduit path within the heat exchanger. A different hot fluid, such as hot water supplied from the engine of the delivery vehicle, is passed through a second conduit path of the heat exchanger. The thermal transfer of heat from the second conduit path to the first conduit path vaporizes the inlet delivery fluid to produce an amount of vapor that is introduced into the vapor space of the delivery tank.

While generally operable, this approach has limitations. For one thing, the shell-and-tube heat exchanger is relatively large, relies on pressurized feed based on the internal pressure of the delivery tank, and incurs damage from such effects as extended vibration from vehicle movement. Such damage can cause cross-contamination and reduced efficiency over time. For another thing, this system is also limited in terms of the ability to accommodate a wide range of pressure and temperature ranges, as well as different pumping rates.

Accordingly, there is a need for improvements in the art of delivering pressurized fluids from a portable delivery system, and it is to such improvements that the present invention is directed.

SUMMARY OF THE INVENTION

A delivery system is provided for transferring a delivery fluid from a delivery tank to a customer tank while maintaining a desired vessel pressure in the delivery tank. The delivery system includes a piping system between the delivery tank and the customer tank and a pump to transport the delivery fluid through the piping system. The delivery system also includes a slip-stream junction where part of the flow downstream of the pump is diverted back to the delivery tank. The flow that is diverted back to the delivery tank passes through a variable flow control valve and a heat exchanger, where the delivery fluid exchanges heat with a hot heat exchanger fluid to vaporize the delivery fluid diverted back to the delivery tank. A heat exchanger fluid source provides the heat exchanger fluid to a heat exchanger pump assembly, which transports the heat exchanger fluid through the heat exchanger.

The vessel pressure in the delivery tank is controlled by: (1) adjusting the flow rate of the delivery fluid fed back to the delivery tank by adjusting the variable flow control valve; and (2) adjusting the rate of flow of heat exchanger fluid through the heat exchanger pump assembly. A programmable controller controls the adjustments of the variable flow control valve and the heat exchanger pump flow rate in response to signals received from control elements. The control elements may be a pressure sensor in a vapor space of the delivery tank, a temperature sensor in the vapor space of the delivery tank, a flow meter located in the piping system between the pump assembly and the slip-stream junction, a vibration detector attached to the delivery tank, or some suitable combination of these control elements.

These and various other features as well as advantages which characterize the claimed invention will become apparent upon reading the following detailed description and upon reviewing the associated drawings and appended claims.

DETAILED DESCRIPTION

The present invention is directed to an apparatus and method for equalizing vessel pressure in a point of sale delivery vessel to improve fluid transfer to a customer tank.

Figure 1:
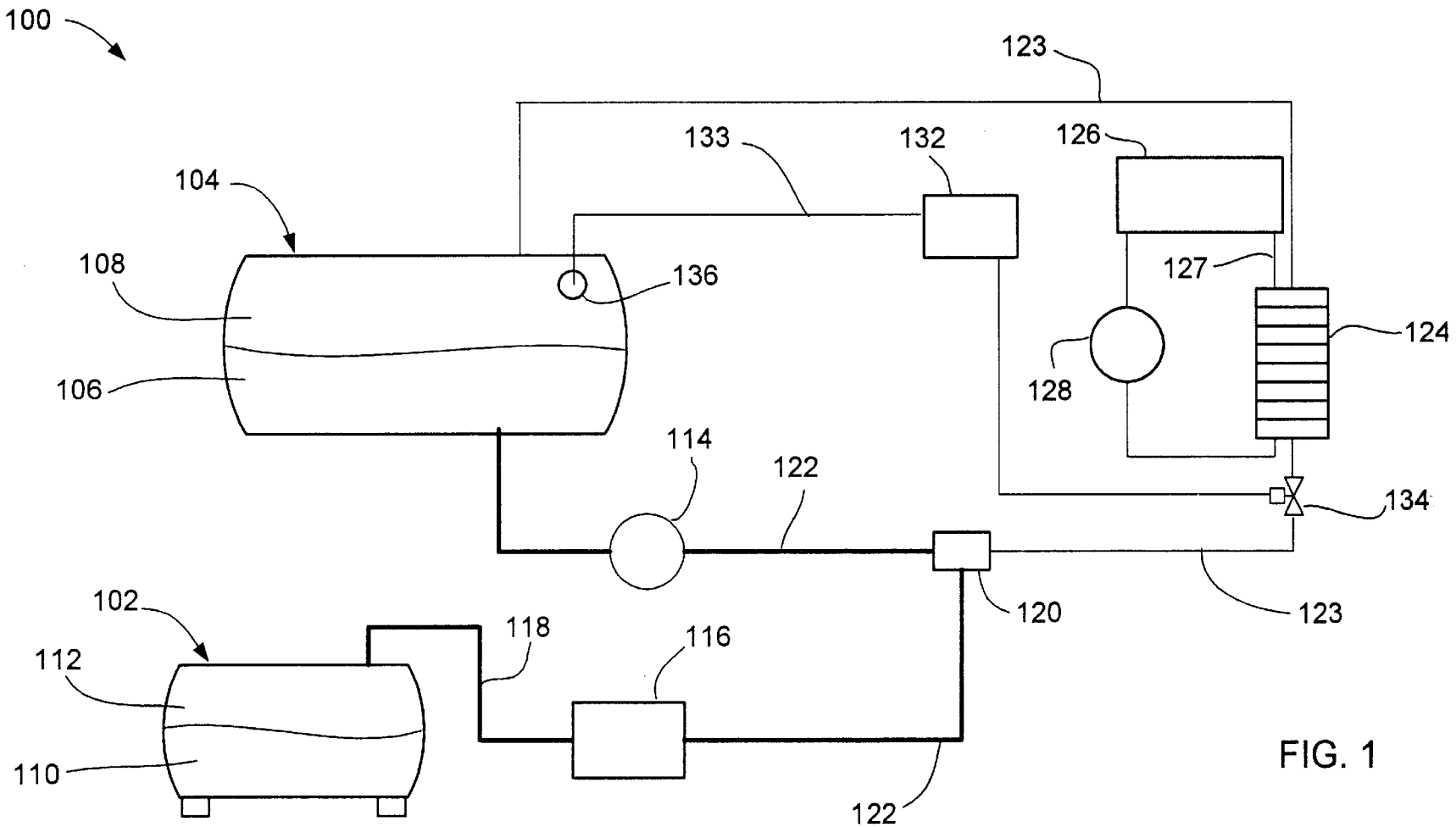
FIG. 1 is a schematic diagram of a delivery system for a liquefied gas constructed in accordance with the present invention.

FIG. 1 provides a generalized schematic diagram of a delivery system 100 used to transfer delivery fluid to a customer tank 102 in accordance with a preferred embodiment. The delivery system comprises a portable delivery tank 104 that can be mounted on a delivery vehicle (not shown), the delivery tank 104 having a liquid space 106 defined by a volume of liquid delivery fluid and a vapor space 108 above the liquid space 106 defining a volume of vapor.

Under steady state conditions, the liquid and vapor in the delivery tank 104 achieve an equilibrium condition of pressure and temperature by the continuous evaporation of small amounts of liquid and condensation of small amounts of vapor. The customer tank 102 also has corresponding liquid and vapor spaces 110, 112, with the liquid space 110 initially at a low level when a fluid transfer operation is to be undertaken.

The delivery system 100 further includes a pump assembly 114 configured to pump liquid from the delivery tank 104 at a desired flow rate, a meter 116 which measures the amount of transferred liquid, and a flexible hose 118 configured to connect to the customer tank 102. It will be understood by those skilled in the art that the delivery system 100 includes various additional features such as shutoff and pressure relief valves, but such are not believed necessary for the present discussion and so have been omitted for clarity.

A slip-stream junction 120, or partial by-pass valve, is provided in a conduit 122 which is connected to the outlet port of the pump assembly 114 and extends to the meter 116, permitting passage of a relatively small slip stream of the pumped delivery fluid to pass via a first slip conduit 123 to a first conduit path of a plate heat exchanger 124. A second slip conduit communicates between the first conduit path of the plate heat exchanger 124 to the vapor space 108 in the delivery tank 104. The conduit 122 and the flexible hose 118 are part of a piping system that connects the delivery tank 104 and the customer tank 102.

A heat exchange fluid is circulated from a heat exchanger fluid source 126 through a second conduit 127 and to a second conduit path of the heat exchanger 124 by a pump assembly 128. Hot water from the vehicle engine is an acceptable heat exchange fluid when it is necessary to have the heat exchanger fluid hotter than the delivery fluid.

However, it is contemplated that in some circumstances the heat exchanger fluid may be required to be cooler than the delivery fluid. Thus, the heat exchanger 124 can be used to add or to remove heat from the delivery fluid as required to maintain equilibrium conditions in the delivery tank 104 since ambient or outside environmental conditions will heat or cool the delivery fluid in the delivery tank 104.

The equilibrium conditions in the delivery tank 104 will normally be maintained by controlling the pressure and temperature within acceptable ranges. This can be achieved by using a compressor system (not shown) or a refrigeration system (not shown) to control one or both of the pressure and temperature, respectively, within the delivery tank 104. The choice of using a compressor system or a refrigeration system will depend on the thermodynamic properties of the delivery fluid, such as the boiling condensation properties of the fluid. For either system, use of the heat exchanger to cool, as well heat, the delivery fluid is regarded to be a supplemental mode of operation when required to maintain equilibrium conditions in the delivery tank 104.

For the more common situation in which there is need for the heat exchanger 124 to be operated in its heating mode, and thermal transfer from the hot exchanger fluid to the passing slip stream liquid causes conversion (evaporation) of the slip stream liquid into a vapor state, and the vapor passes to the vapor space 108 of the delivery tank 104. In this way, the pressure in the vapor space 108 is regulated sufficiently to suppress the boiling of liquid and preventing cavitation.

A suitable plate heat exchanger is commercially available as Model FP5X12-20 from Flat Plate, Inc., York, Pa., USA. An advantage of the use of a plate heat exchanger is the increased durability, reduced form factor and increased temperature and pressure range capabilities as compared to a shell-and tube heat exchanger. The slip-stream junction or diverter 120 preferably comprises a relatively small orifice (not shown) through which the slip stream liquid passes via the slip stream conduit 123 to the heat exchanger 124. The size of the orifice is selected to accommodate a desired rate of a secondary flow, also referred to herein as the slip stream liquid, sufficient to prevent cavitation for a selected flow rate of the pump assembly 114. The slip stream liquid is the portion of delivery fluid that is diverted for return to the delivery tank 104 via the slip stream conduit 123. The appropriate orifice size can be calculated or empirically selected based on the particulars of a given application.

The delivery system 100 also includes a controller 132 and a variable flow valve 134 (such as a diaphragm controlled valve). The controller 132 can comprise any of a number of commercially available mechanical or electrical circuit configurations, including a programmable logic controller (PLC), which controllably adjusts the flow of the secondary fluid into the heat exchanger 124. A sensor or sensing element 136 is provided to communicate with the vapor space 108 to detect changes in an internal condition or parameter in the delivery tank 104. As changes in the monitored internal condition in the delivery tank 104 occur, such condition change is provided to the controller 132, which in turn adjusts the valve 134 to maintain the monitored internal condition or parameter within a desired range. When the internal condition selected for control is pressure, the sensing element 136 will be a pressure sensing element; when the internal condition selected for control is the temperature in the delivery tank 104, the sensing element 136 will be a temperature sensing element. Of course, the configuration of the controller 132 is mated to work with the selected sensing element 136 and adjusts the valve 134 to maintain the monitored pressure or temperature within a desired range.

Figure 2:
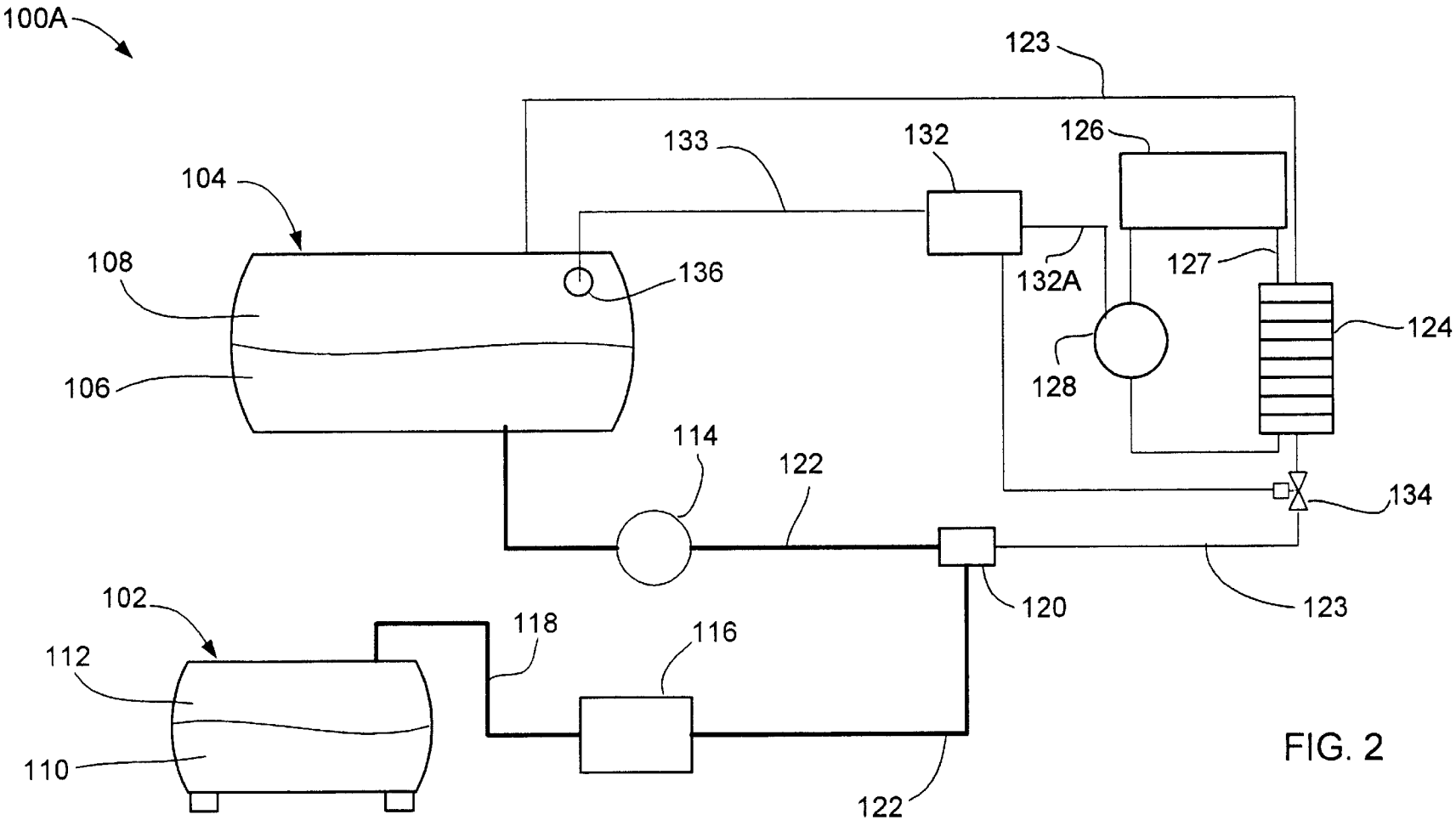
FIG. 2 is a schematic diagram of another delivery system for a liquefied gas constructed in accordance with the present invention.

FIG. 2 shows a delivery system 100A, another embodiment of the present invention. The construction of the delivery system 100A is substantially identical to that described for the delivery system 100 hereinabove with the exceptions now to be noted. In the delivery system 100A the controller 132 communicates with the motor portion of the heat exchange pump assembly 128 via line 132A permitting the controller 132 to vary the flow rate from the pump assembly 128. For example, should the sensing element 136 sense a pressure drop in the vapor space 108 of the delivery tank 104 or sense liquid in line 133, the controller 132 will increase the speed of the pump assembly 128 to increase the flow rate of heat exchanger fluid through the heat exchanger 124, thereby vaporizing more of the slip stream liquid flowing to the delivery tank 104 via the conduit 123. Since more vapor is thereby being delivered to the vapor space 108, the pressure is increased in the delivery tank 104, and by the use of known feed back control circuitry logic in the controller 132, pressure is maintained in the delivery tank 104 even during occurrence of a declining fluid level therein during delivery of fluid to the customer tank 102 by the pump assembly 114.

Figure 3:
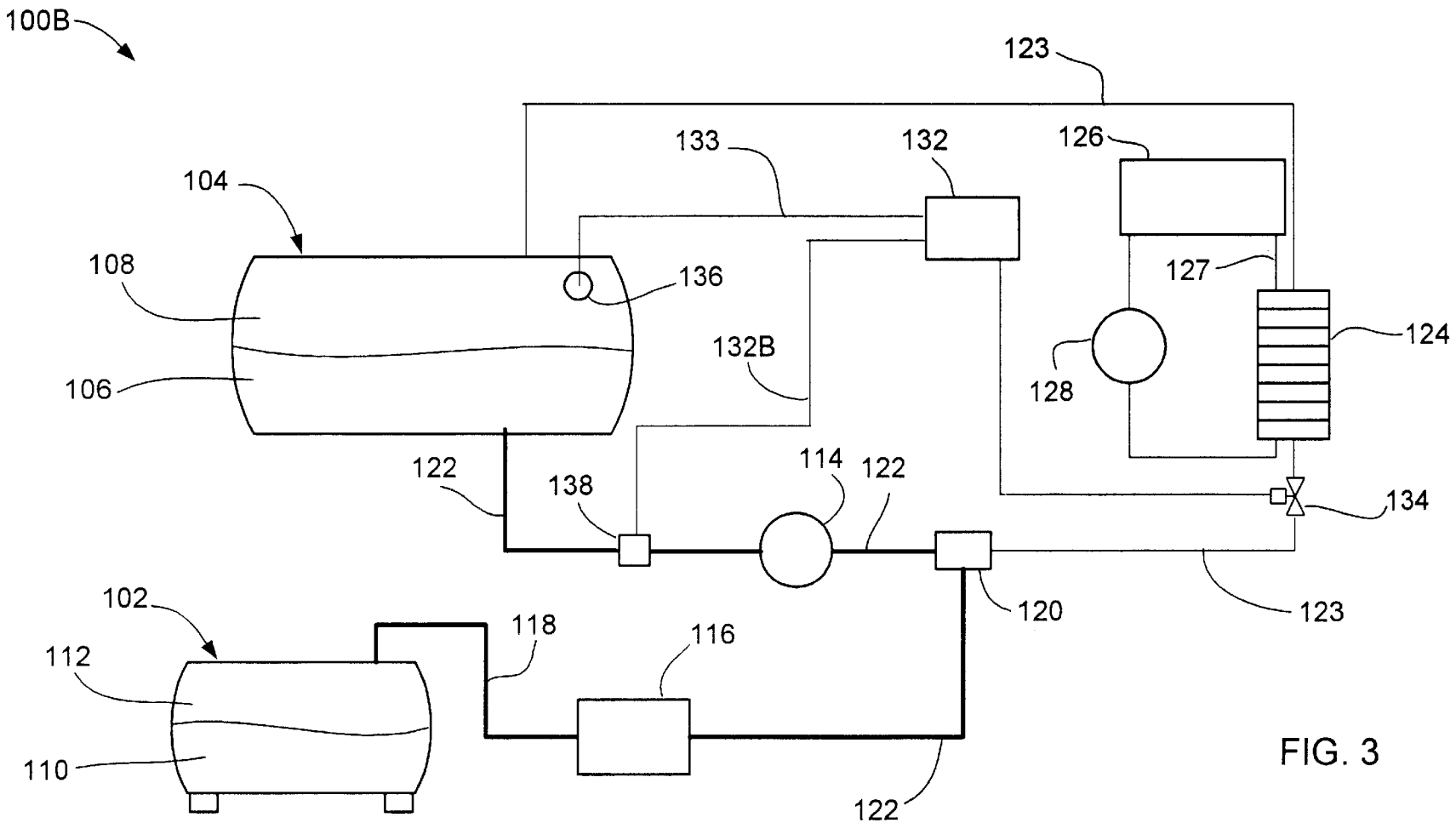
FIG. 3 is a schematic diagram of one other delivery system for a liquefied gas constructed in accordance with the present invention.

FIG. 3 shows a delivery system 100B, which is yet another embodiment of the present invention. The construction of the delivery system 100B is substantially identical to that described for the delivery system 100 hereinabove with the exceptions now to be described. The delivery system 100B has a vapor sensor 138 located in the first conduit 122 upstream to the pump assembly 114. The vapor sensor 138 communicates with the controller 132 via line 132B. The vapor sensor 138 senses delivery fluid pumped by the pump assembly 114 and signals the controller 132. A reduction in the liquid generally indicates entrainment of vapor in the liquid flowing to the pump assembly 114, which in turn signals a drop in pressure in the vapor space 108. The controller 132 responds to this reduction in liquid phase by further opening valve 134 which increases the amount of slip stream liquid to the heat exchanger 124, thereby increasing the amount of vapor passed to the vapor space 108 in the delivery tank 104, thereby maintaining the pressure in the delivery tank 104 even during occurrence of a declining liquid level during delivery of fluid to the customer tank 102.

Figure 4:
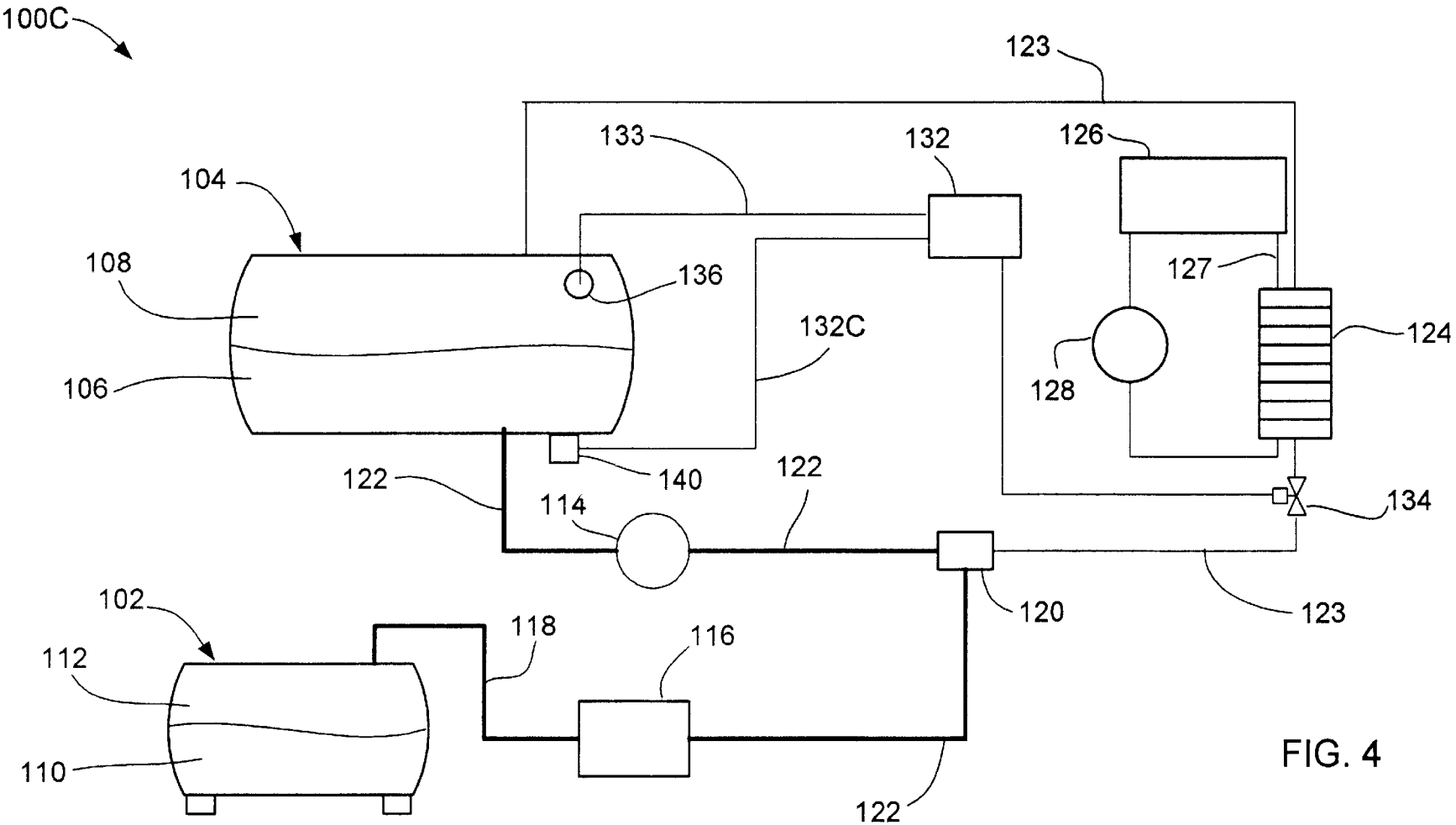
FIG. 4 is a schematic diagram of yet another delivery system for a liquefied gas constructed in accordance with the present invention.

FIG. 4 depicts one other delivery system 100C, which is another embodiment of the present invention. The construction of the delivery system 100C is substantially identical to that described for the delivery system 100 hereinabove with the exceptions now to be described. The delivery system 100C is provided with a vibration detector 140 that is mounted onto the delivery tank 104 and communicates with the controller 132 via line 132C. The vibration detector 140 can be an accelerometer that can sense a vibration of the delivery tank 104 that occurs with the onset of cavitation occurring in the pump assembly 114. When the vibration detector 140 transmits a vibration detection signal to the controller 132, the controller 132 responds by further opening the valve 134 which increases the amount of slip stream liquid to the heat exchanger 124, thereby increasing the amount of vapor passed to the vapor space 108 in the delivery tank 104, thereby maintaining the pressure within the predetermined pressure range in the delivery tank 104 even during occurrence of a declining liquid level during delivery of fluid to the customer tank 102.

For all the embodiments described for FIGS. 1–4, the pressure sensor (or temperature sensor) 136, the vapor sensor 138, and the vibration detector 140 are generally referred to as control elements because these control elements monitor a condition related to the transfer of the delivery fluid and provide information about this condition to the controller 132. The heat exchanger pump assembly 128 and the variable flow control valve 134 are referred to generally as controlled components.

Accordingly, a delivery system (such as 100) is provided for transferring a delivery fluid from a delivery tank (such as 104) to a customer tank (such as 102) while maintaining a predetermined pressure in the delivery tank. The delivery system includes a piping system (such as 122, 118) between the delivery tank and the customer tank and a pump assembly (such as 114) to transport the delivery fluid through the piping system. The delivery system also includes a slip-stream junction (such as 120) where slip stream liquid portion of the flow downstream of the pump assembly is diverted to a slip stream conduit (such as 123) back to the delivery tank. The slip stream liquid portion is passed through a variable flow control valve (such as 134) and a heat exchanger (such as 124), where the slip stream liquid is heated or cooled as required by a heat exchanger fluid to vaporize the slip stream liquid returning to the delivery tank. A heat exchanger fluid source (such as 126) and heat exchanger pump assembly (such as 128) sends heat exchanger fluid through the heat exchanger.

The pressure of vapor in the delivery tank is controlled by: (1) adjusting the flow rate of the slip stream liquid portion returned to the delivery tank by adjusting the variable flow control valve; and (2) adjusting the rate of flow of the heat exchanger fluid through the heat exchanger. A programmable controller (such as 132) controls the control valve and the heat exchanger pump assembly flow rate in response to information received from control elements (such as 136). The control elements can be one or, or a combination of: a pressure sensor in communication with the delivery tank; a temperature sensor in communication with the delivery tank; a vapor sensor detecting the flow of delivery fluid to the pump assembly and thus to the slip-stream junction; or a vibration detector attached to the delivery tank.

It will be understood that while numerous characteristics and advantages of various embodiments of the present invention have been set forth herein, together with details of the structure and function of the various embodiments, the detailed description herein is intended to be illustrative only, as changes can be made in such details as matters of structure and arrangements of parts within the principles of the present invention without departing from the spirit and scope of the present invention. In addition, while the embodiments described are directed to a delivery system for liquefied fluids, it will be appreciated by those skilled in the art that the delivery system can be variously used without departing from such spirit and scope.

What is claimed is:

1. A system for providing transfer of a delivery fluid from a delivery tank to a customer tank while maintaining a desired vessel pressure in the delivery tank, the system comprising:

a pump assembly for pumping fluid from the delivery tank;

a piping system for passing the pumped fluid to the customer tank;

diverter means for diverting a slip stream portion of the pumped fluid;

heat exchanger means for selectively heating or cooling the slip stream portion;

means for returning the slip stream portion to the delivery tank;

sensing means for monitoring a condition in the delivery tank; and control means responsive to the sensing means for controlling the slip stream portion returned to the delivery tank.

2. The system of claim 1 wherein the sensing means comprises a pressure sensor communicating with the delivery tank.

3. The system of claim 1 wherein the sensing means comprises a temperature sensor communicating with the delivery tank.

4. The system of claim 1 further comprising a heat exchanger fluid source.

5. The system of claim 4 wherein the heat exchanger means comprises a heat exchanger fluid pump assembly.

6. The system of claim 5 wherein the control means controls the flow rate of the heat exchanger fluid pump assembly.

7. The system of claim 1 wherein the heat exchanger means comprises a flat plate heat exchanger.

8. In a system for transferring a delivery fluid from a delivery tank to a customer tank, the system having a piping system and a pump assembly to transport the delivery fluid through the piping system, an apparatus for maintaining a vessel pressure in the delivery tank, the apparatus comprising:

(a) a slip-stream junction where part of the delivery fluid downstream of the pump assembly is diverted back to the delivery tank;

(b) a conduit for feeding back delivery fluid downstream of the pump assembly to the delivery tank;

(c) a heat exchanger for exchanging heat between the delivery fluid and a heat exchanger fluid;

(d) a controller;

(e) a control element to monitor a condition related to the transfer of the delivery fluid and provide information to the controller; and (f) a controlled component that the controller adjusts in response to the information provided to the controller from the control element, in order to maintain a determined vessel pressure in the delivery tank, the control element being a vibration detector attached to the delivery tank.

9. In a system for transferring a delivery fluid from a delivery tank to a customer tank, the system having a piping system and a pump assembly to transport the delivery fluid through the piping system, an apparatus for maintaining a determined pressure in the delivery tank, the apparatus comprising:

a slip-stream junction where a portion of the delivery fluid downstream of the pump assembly is diverted back to the delivery tank;

a conduit for feeding back delivery fluid downstream of the pump assembly to the delivery tank;

a heat exchanger for exchanging heat between the delivery fluid and a heat exchanger fluid;

a controller;

a vibration detector to monitor a condition related to the transfer of the delivery fluid and provide information to the controller; and a controlled component that the controller adjusts in response to the information provided to the controller from the vibration detector to maintain a predetermined pressure in the delivery tank.

10. In a system for transferring a delivery fluid from a delivery tank to a customer tank, the system having a piping system and a pump assembly to transport the delivery fluid through the piping system, an apparatus for maintaining a vessel pressure in the delivery tank, the apparatus comprising:

(a) a slip-stream junction where part of the delivery fluid downstream of the pump assembly is diverted back to the delivery tank;

(b) a conduit for feeding back delivery fluid downstream of the pump assembly to the delivery tank;

(c) a heat exchanger for exchanging heat between the delivery fluid and a heat exchanger fluid;

(d) a controller;

(e) a control element to monitor a condition related to the transfer of the delivery fluid and provide information to the controller, control element being a flow meter located in the piping system between the pump assembly and the slip-stream junction;

(f) a controlled component that the controller adjusts in response to the information provided to the controller from the control element, in order to maintain a predetermined vessel pressure in the delivery tank.

* * * * *